US005660072A

United States Patent [19]

Lee

[11] Patent Number: 5,660,072

[45] Date of Patent: Aug. 26, 1997

[54] PROCESS FOR PRODUCING A HANDLEBAR STEM

[76] Inventor: Kun Hu Lee, No. 63 Wouen Chiu Road, Tachia, Taichung, Taiwan

[21] Appl. No.: 596,629

[22] Filed: Feb. 5, 1996

[51] Int. Cl.[6] ..... B21D 19/08

[52] U.S. Cl. ..... 72/294; 72/370

[58] Field of Search ..... 72/370, 367, 294, 72/318

[56] References Cited

U.S. PATENT DOCUMENTS

| | | | |
|---|---|---|---|
| 1,966,053 | 7/1934 | Squires | 72/370 |
| 3,508,428 | 4/1970 | Matson | 72/370 |
| 4,062,701 | 12/1977 | Juhas | 72/370 |
| 4,796,457 | 1/1989 | Iijima | 72/370 |

FOREIGN PATENT DOCUMENTS

| | | | |
|---|---|---|---|
| 2838157 | 3/1980 | Germany | 72/370 |

*Primary Examiner*—Daniel C. Crane

*Attorney, Agent, or Firm*—Charles E. Baxley, Esq.

[57] ABSTRACT

A process for producing a handlebar stem includes Steps as follows: (1) providing a handlebar stem raw material piece comprising a cylindrical metal tube with a central axis and a thickened open end terminating in a margin and having an outer wall; (2) forming an annular recess from the outer wall in the vicinity of the margin, the annular recess having an outer shoulder and an inner shoulder both perpendicular to the central axis; (3) axially punching the open end of the raw material piece with a punching member to form a flange on the open end that is perpendicular to the central axis.

1 Claim, 4 Drawing Sheets

PROCESS FOR PRODUCING A HANDLEBAR STEM

BACKGROUND OF THE INVENTION

1. Field of the Invention

The present invention relates to a process for producing a handlebar stem and, more particularly, to a novel process for producing a handlebar stem which can fixedly engage with an upper end of a front fork to prevent relative rotational movements therebetween.

2. Description of the Related Art

Bicycles are particularly popular transportation means throughout the world as they also provide opportunities for recreation, exercise and sport. Continual efforts have been made to improve structures of bicycles whereby they may become stronger, lighter, more efficient and user-friendly. FIG. 7 of the drawings illustrates a conventional combination of a handlebar stem and an upper part of a front fork in which the latter is rectangular in shape in an upper end thereof while the former includes an R-shaped connecting edge such that the former and the latter cannot be fixedly connected to rotate therewith in a reliable manner when required (such as turning). Accordingly, injury may be caused to a cyclist if relative rotational movements occur between the handlebar stem and the upper part of the front fork as a gap is defined therebetween.

The present invention is intended to provide a novel process for producing a handlebar stem to mitigate and/or obviate the foregoing problems.

SUMMARY OF THE INVENTION

It is an object of the present invention to provide a novel process for producing a handlebar stem which includes the steps of:

(1) providing a handlebar stem raw material;

(2) providing an annular recess in an upper end of the handlebar stem raw material; and (3) punching the upper end of the handlebar stem raw material to form a perpendicular flange on the upper end.

A handlebar stem so produced may be secured fixedly to an upper part of a front fork to prevent relative rotational movements therebetween.

Other objects, advantages, and novel features of the invention will become more apparent from the following detailed description when taken in conjunction with the accompanying drawings.

DESCRIPTION OF THE PREFERRED EMBODIMENT

Figures 1, 2, 3:
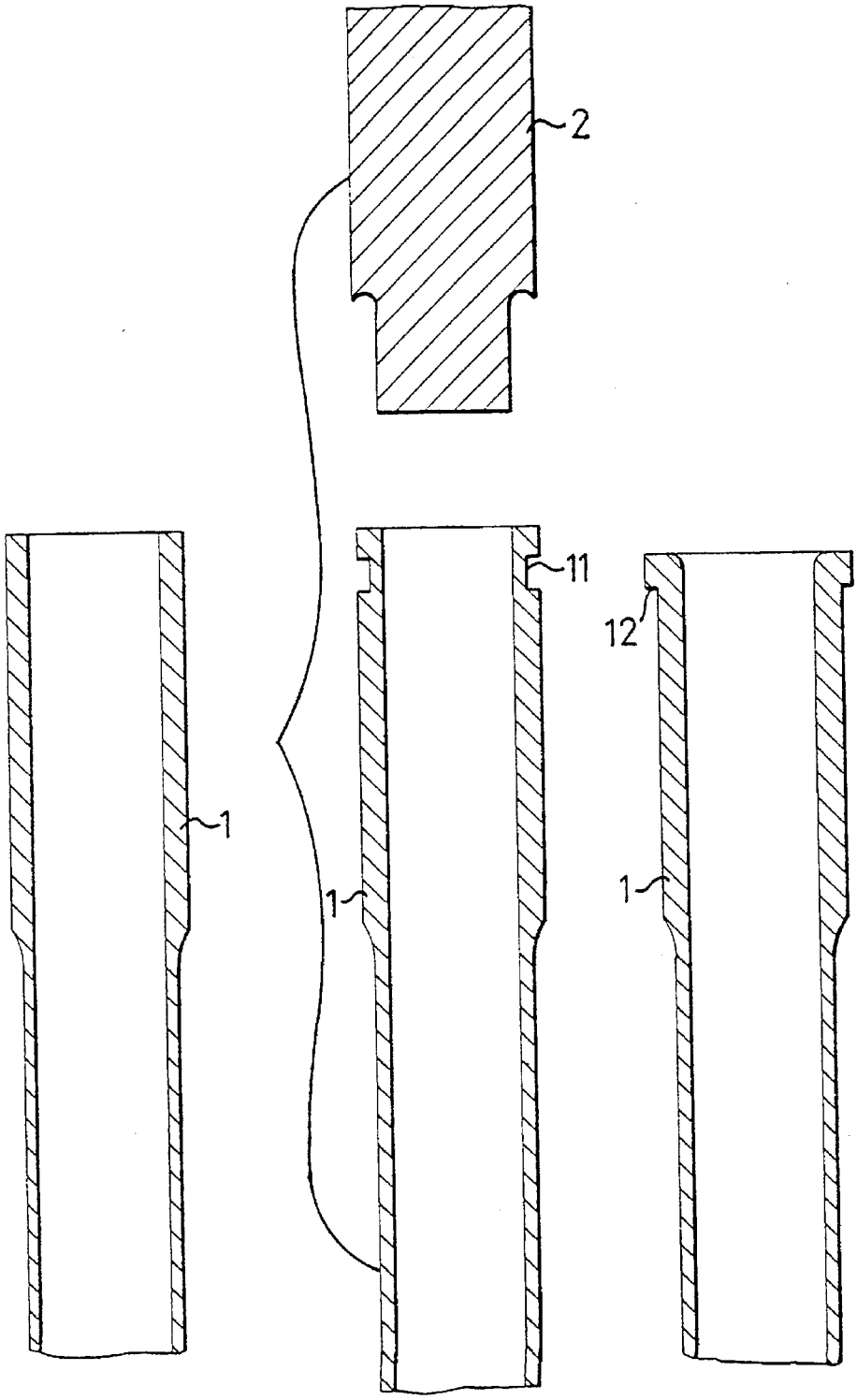
FIGS. 1–3 are cross-sectional views illustrating a process for producing a handlebar stem in accordance with the present invention.
Figure 4:
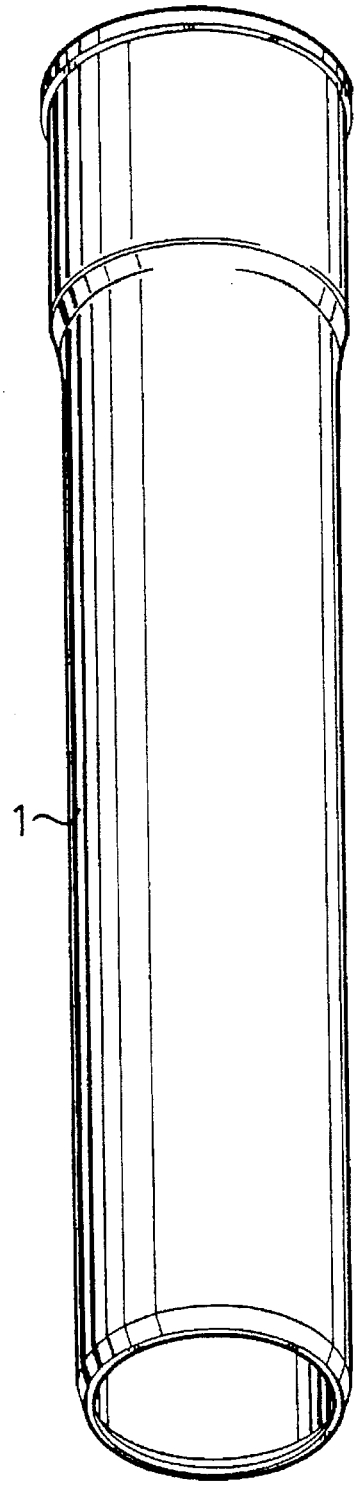
FIG. 4 is a perspective view illustrating a handlebar produced by a process in accordance with the present invention.
Figure 6:
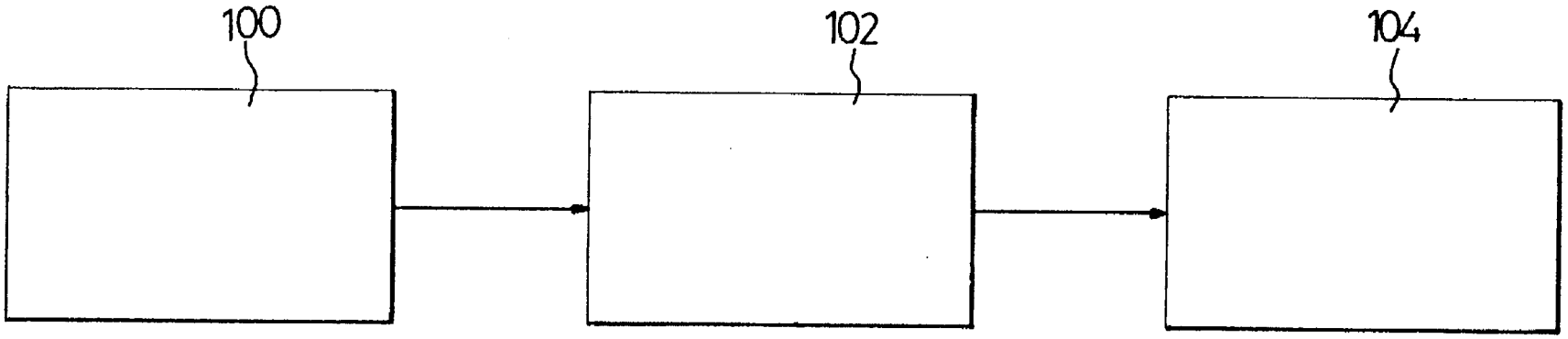
FIG. 6 is a block diagram illustrating steps for producing a handlebar stem in accordance with the present invention.

Referring to the drawings and initially to FIGS. 1 to 3 and FIG. 6, a process for producing a handlebar stem in accordance with the present invention comprises (1) providing a handlebar stem raw material 1 (see FIG. 1 and step 100 in FIG. 6); (2) providing an annular recess 11 in an upper end of the handlebar stem raw material 1 by milling or other suitable processing (step 102 in FIG. 6); and (3) punching the upper end of the handlebar stem raw material 1 (see FIG. 3, and step 104 in FIG. 6) to form a perpendicular flange on the upper end, such as by applying a punching member 2 to the upper end of the handlebar stem raw material, an operation of which is conventional and beyond the scope of the invention such that further description thereof is not required. A handlebar stem 1 produced by the above process is shown in FIG. 4 and includes an upper end with a perpendicular flange thereon.

Figure 5:
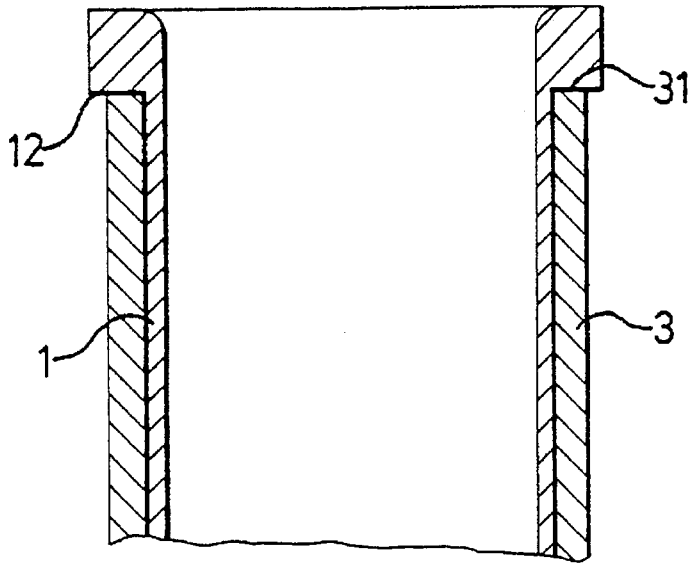
FIG. 5 is a cross-sectional view illustrating a connection between the handlebar stem in FIG. 4 and an upper part of a front fork.
Figure 7:
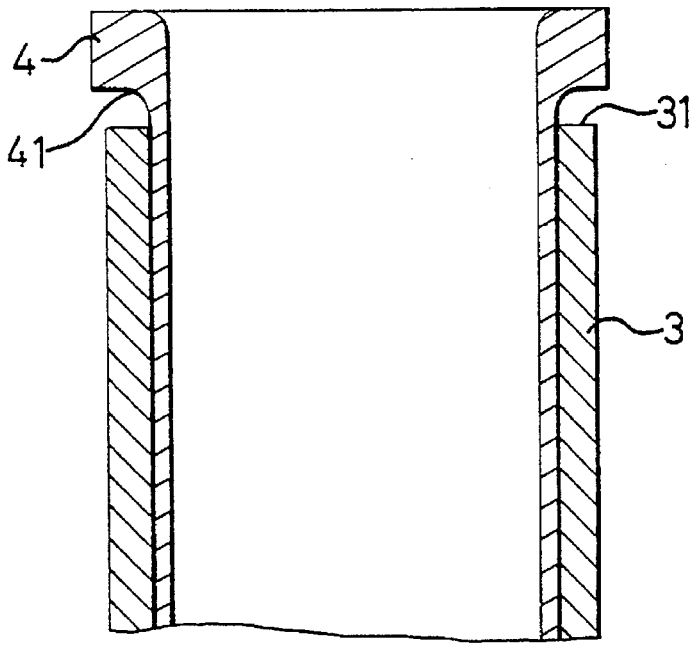
PRIOR ART Fig 7
FIG. 7 is a cross-sectional view illustrating a connection between a handlebar stem and an upper part of a front fork according to prior art.

FIG. 5 illustrates a connection between the handlebar stem 1 and an upper part 3 of a front fork in which the former includes a perpendicular connecting edge 12 for connection with the upper part 3 such that these two members 1 and 3 are fixedly secured to rotate together without relative rotational movements therebetween under a frictional force therebetween exerted by a force applied by the upper part 3 of the front fork to the handlebar stem 1.

Accordingly, the present invention provides a novel, simple method to produce a handlebar stem which can be fixedly secured to the front fork in a reliable manner to solve the problem in the prior art handlebar stem and front fork connection.

Although the invention has been explained in relation to its preferred embodiment, it is to be understood that many other possible modifications and variations can be made without departing from the spirit and scope of the invention as hereinafter claimed.

What is claimed is:

1. A process for producing a handlebar stem comprising steps of:

providing a handlebar stem raw material piece comprising a cylindrical metal tube with a central axis and a thickened open end terminating in a margin and having an outer wall;

forming an annular recess from the outer wall in the vicinity of the margin, the annular recess having an outer shoulder and an inner shoulder both perpendicular to the central axis;

axially punching the open end of the raw material piece with a punching member to form a flange on the open end that is perpendicular to the central axis.

* * * * *